US010829897B2

(12) United States Patent
Springer

(10) Patent No.: US 10,829,897 B2
(45) Date of Patent: Nov. 10, 2020

(54) TAMPING MACHINE AND METHOD FOR CORRECTING THE POSITION OF A TRACK

(71) Applicant: PLASSER & THEURER EXPORT VON BAHNBAUMASCHINEN GESELLSCHAFT M.B.H., Vienna (AT)

(72) Inventor: Heinz Springer, Minato-ku (JP)

(73) Assignee: Plasser & Theurer, Export von Bahnbaumaschinen, Gesellschaft m.b.H., Vienna (AT)

( * ) Notice: Subject to any disclaimer, the term of this patent is extended or adjusted under 35 U.S.C. 154(b) by 267 days.

(21) Appl. No.: 15/779,206

(22) PCT Filed: Nov. 2, 2016

(86) PCT No.: PCT/EP2016/001818
§ 371 (c)(1),
(2) Date: May 25, 2018

(87) PCT Pub. No.: WO2017/092840
PCT Pub. Date: Jun. 8, 2017

(65) Prior Publication Data

US 2019/0271120 A1 Sep. 5, 2019

(30) Foreign Application Priority Data

Dec. 2, 2015 (AT) ..... A 774/2015

(51) Int. Cl.
*E01B 27/17* (2006.01)
*B06B 1/18* (2006.01)
*E01B 27/20* (2006.01)

(52) U.S. Cl.
CPC ..... *E01B 27/17* (2013.01); *B06B 1/18* (2013.01); *E01B 27/20* (2013.01)

(58) Field of Classification Search
CPC ..... E01B 27/00; E01B 27/02; E01B 27/12; E01B 27/16; E01B 27/17; E01B 29/00; E01B 29/04; E01B 33/00
See application file for complete search history.

(56) References Cited

U.S. PATENT DOCUMENTS 5,007,350 A 4/1991 Theurer
5,205,218 A 4/1993 Theurer

FOREIGN PATENT DOCUMENTS

EP 0416193 A1 3/1991
EP 0518845 A1 * 12/1992 ..... E01B 27/16
EP 0518845 A1 12/1992
WO 2008009314 A1 1/2008

* cited by examiner

*Primary Examiner* — Robert J McCarry, Jr.
(74) *Attorney, Agent, or Firm* — Laurence A. Greenberg; Werner H. Stemer; Ralph E. Locher

(57) ABSTRACT

A tamping machine for tamping a track has a lifting-lining unit, connected to lifting and lining drives, for shifting the track into a target position. A vibration generator, which can be set to vibrate, is disposed on the lifting-lining unit. It is thereby possible to tamp a track section in a first working pass and to lower it in a controlled way in an immediately following second working pass with constant impact of vertical load and vibration. Thereafter, the track can be traveled upon with normal speed entirely unhindered.

7 Claims, 2 Drawing Sheets

TAMPING MACHINE AND METHOD FOR CORRECTING THE POSITION OF A TRACK

BACKGROUND OF THE INVENTION

Field of the Invention

The invention relates to tamping machine for tamping a track and to a method of carrying out a position correction of a track. The tamping machine has a tamping unit arranged between on-track undercarriages and, immediately preceding the tamping unit with regard to a working direction, a lifting-lining unit which has flanged rollers mounted on an assembly frame and is equipped with lifting- and lining drives for shifting the track into a target position prescribed by a track measuring system. In the method for a position correction of a track, the track is gripped by a lifting-lining unit, lifted into a target position prescribed by a track measuring system and tamped by ballast compaction.

Tamping machines for tamping a track are widely known and are essentially equipped with a tamping unit, a lifting-lining unit and a track measuring system. With the aid of the track lifting-lining unit, the track is lifted into a target position according to the position faults indicated by the track measuring system, and fixed in this position by using the tamping unit.

In order to preclude the initial settlements of the track which frequently occur after tamping, the track is set in horizontal transverse vibrations while under the permanent effect of a high vertical load by operation of a so-called Dynamic Track Stabilizer (for example according to WO2008/009314). This results in a controlled settlement of the track and a corresponding compaction of the sleeper beds. With this, the settlement of the track—inevitable after tamping—is specifically anticipated.

BRIEF SUMMARY OF THE INVENTION

It is the object of the present invention to provide a tamping machine and a method of the type mentioned at the beginning with which an extended range of operations becomes possible.

According to the invention, this object is achieved by way of the features as claimed.

With a combination of features of this sort, the operational range of a tamping machine can be expanded in a particularly advantageous manner inasmuch as it is possible with a minimum of additional structural expense to provide a choice, if required, between a track position correction by tamping or a track position correction by targeted track lowering. These advantages can be used optimally particularly in short track sections bounded by switches, for example in a railway station area, since it is possible in connection with a relatively short track closure to already carry out a complete position correction, as a result of which the track section can be opened for rail traffic without limitations.

Additional advantages of the invention become apparent from the dependent claims and the drawing description.

BRIEF DESCRIPTION OF THE SEVERAL VIEWS OF THE DRAWING

The invention will be described in more detail below with reference to embodiments represented in the drawing.

DESCRIPTION OF THE INVENTION

Figure 1:
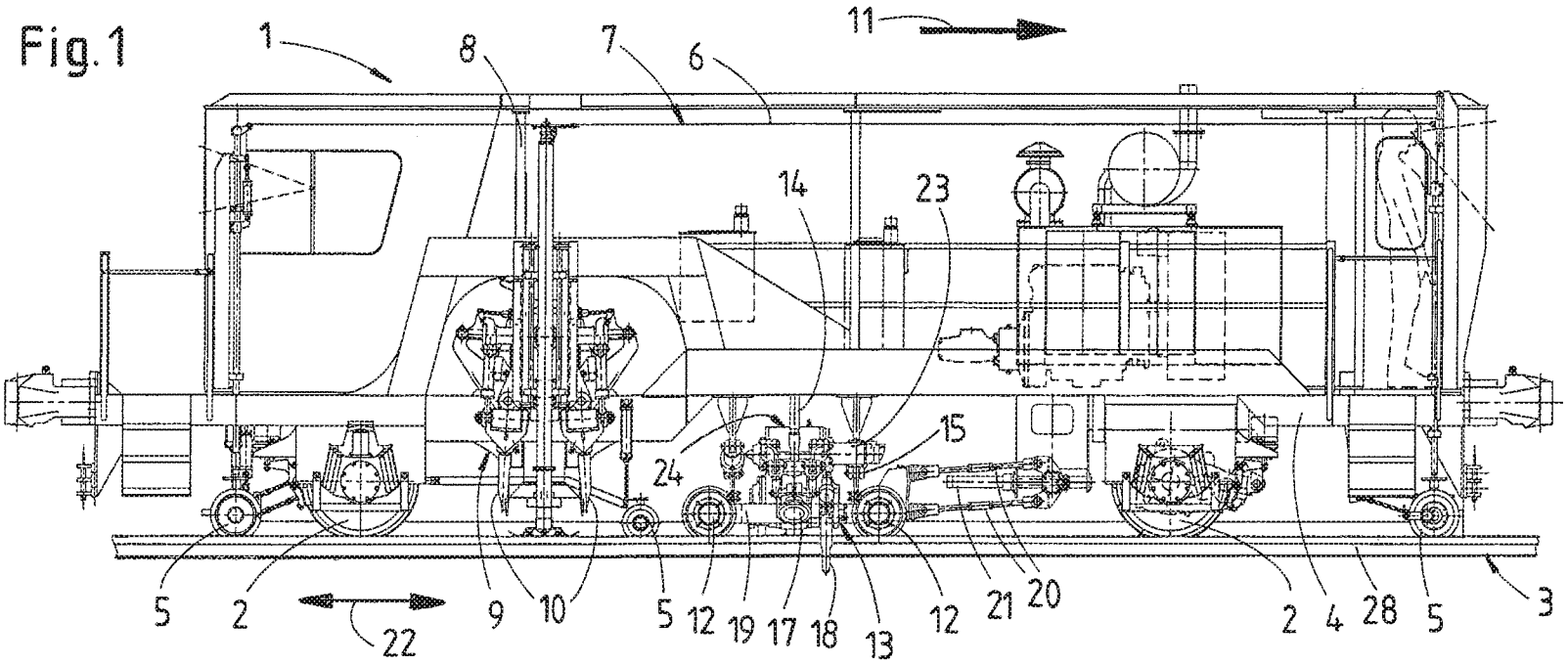
FIG. 1 shows a side view of a tamping machine having a lifting-lining unit.

A tamping machine 1 shown in FIG. 1 has a machine frame 4 mobile on a track 3 by means of on-track undercarriages 2. Provided for detecting track position faults is a track measuring system 7 having measuring axles 5 and measuring chords 6. A tamping unit 9, vertically adjustable by means of a drive 8, is equipped with tamping tines 10 designed for immersion into ballast of the track 3 for tamping.

Located immediately in front of the tamping unit 9—with regard to a working direction 11 of the tamping machine 1—is a lifting-lining unit 13, designed to roll on the track 3 via flanged rollers 12, which has an assembly frame 19. The latter is connected to the machine frame 4 via lifting- and lining drives 14, 15 (see FIGS. 2, 3) in order to shift the track 3 into a target position prescribed by the track measuring system 7. To establish a force-locking connection to the track 3, lifting rollers 17 pivotable by a drive 16 (see FIGS. 2, 3) and a vertically adjustable lifting hook 18 are connected to the assembly frame 19. The latter is articulatedly connected to the machine frame 4 by means of linking rods 20 and displaceable relative to the machine frame 4 in a longitudinal direction 22 of the machine by means of a drive 21.

Figure 2:
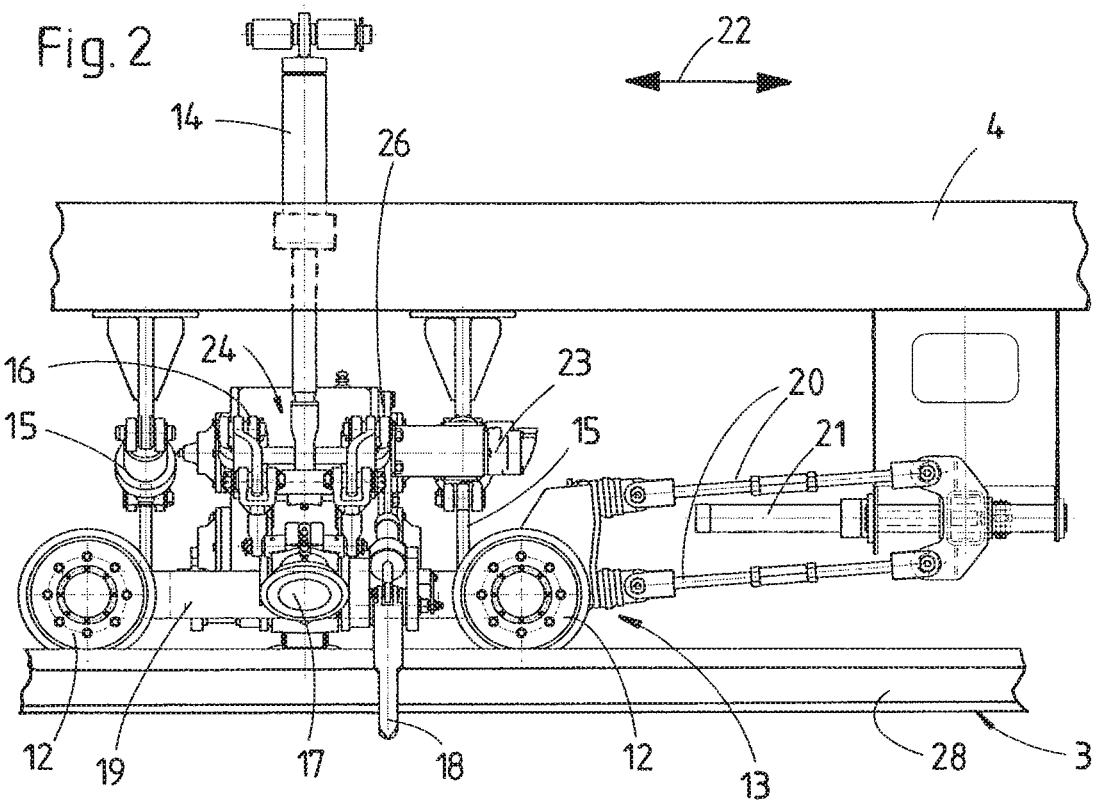
FIGS. 2 and 3 show an enlarged side view of the lifting-lining unit and the view thereof in a longitudinal direction of the machine, respectively.
Figure 3:
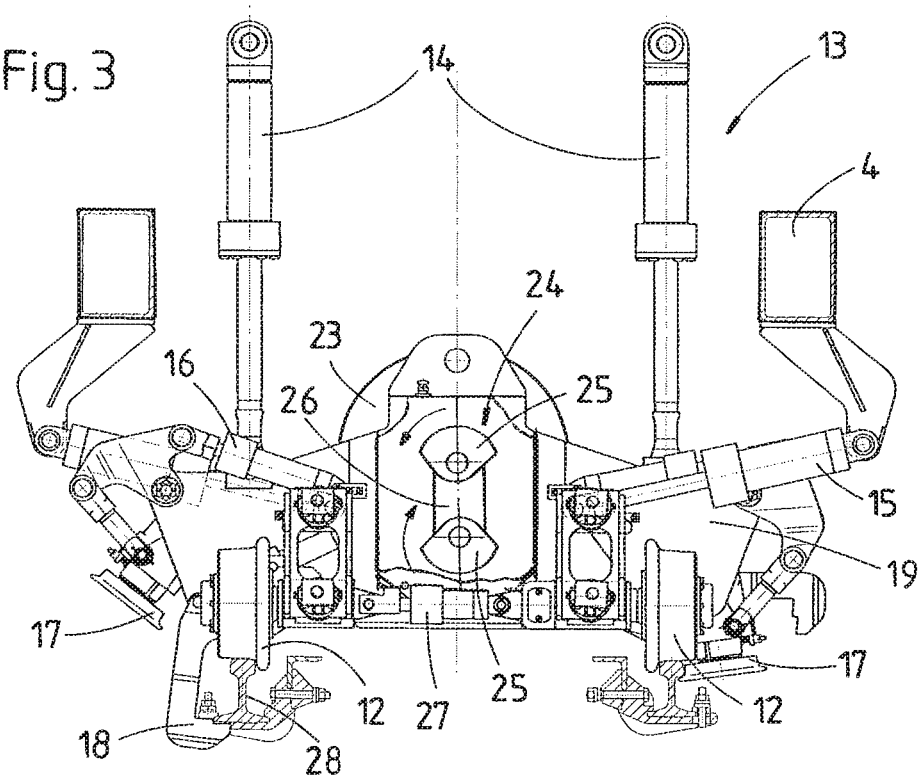

As can be seen particularly in FIGS. 2 and 3, the lifting-lining unit 13 is connected to a vibration generator 24 which is designed to be set in vibrations by a hydraulic drive 23 and has two imbalance masses 25 designed to be set in rotation in opposite directions by the drive 23 and a gearbox 26. The flanged rollers 12 are designed for displacement relative to the assembly frame 19 in a horizontal direction extending perpendicularly to the longitudinal direction 22 of the machine by drives 27 (see FIG. 3).

To carry out a position correction, in a first working pass a section of the track 3 is lifted into the target position, prescribed by the track measuring system 7, by operation of the lifting-lining unit 13 and (in the case of the tamping machine 1 shown in FIG. 1) tamped in the course of discontinuous forward working travel from sleeper to sleeper. For lifting the track 3, either the lifting rollers 17 or the lifting hook 18 are brought into engagement with rails 28, as desired.

For anticipating initial settlements of the track 3, the just tamped section is lowered in a controlled way in a subsequent second working pass with involvement of the track measuring system 7. To that end, the track 3—gripped in a force-locked way by applying the lifting rollers 17 to the rails 28—is loaded with a vertical load during continuous forward working travel with actuation of the drives 14 (which are now actuated in opposite direction as compared to the first working pass). At the same time, with actuation of the drives 23, an activation of the vibration generator 24 takes place along with a rotation of the imbalance masses 25 resulting therefrom, whereby the track 3 is set continuously in horizontal vibrations extending perpendicularly to the longitudinal direction 22 of the machine.

With this second working pass concluding the track treatment, a uniform structure of the ballast compaction and thus an advantageous increase of the resistance to lateral displacement are achieved. As a result, the track can immediately be travelled upon with unlimited speed while avoiding disadvantageous speed restrictions.

As an alternative to the vibration generator 24 having rotating imbalance masses, the vibrations could also be generated by a hydraulic vibration drive.

Figure 4:
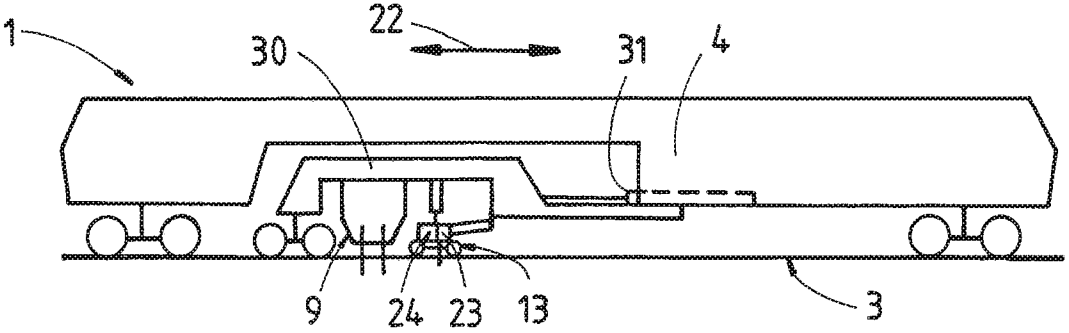
FIG. 4 shows a simplified representation of a further embodiment of the tamping machine.

According to the embodiment visible in FIG. 4, the tamping machine 1 has a satellite frame 30 which is displaceable relative to the machine frame 4 in the longitudinal direction 22 of the machine by means of a drive 31. The tamping unit 9 and lifting-lining unit 13 are connected to the satellite frame 30. A track measuring system required for the track position correction is not shown here for the sake of simplicity.

In a first working pass for treating a track section, the tamping machine 1 moves continuously while parallel thereto the satellite frame 30, together with the tamping unit 9 and lifting-lining unit 13, is moved discontinuously from one tamping location to the next. In an immediately following second working pass, the satellite frame 30 is operated together with the machine frame 4 in a continuous working forward run. During this, a constant vibration- and load transfer upon the track 3—as already described with regard to FIGS. 1 to 3—takes place with the aid of the vibration generator 24 positioned on the lifting-lining unit 13.

The invention claimed is:

1. A tamping machine for tamping a track, the tamping machine comprising:

a tamping unit arranged between on-track undercarriages;

a lifting-lining unit disposed immediately preceding said tamping unit in a working direction, said lifting-lining unit having flanged rollers mounted on an assembly frame and being equipped with lifting and lining drives for shifting the track into a target position prescribed by a track measuring system; and a vibration generator connected to said lifting-lining unit and a drive configured to cause said vibration generator to vibrate; and a gearbox configured to connect said two imbalance masses to one another for synchronous opposite rotation and for generating horizontal vibrations extending perpendicularly to a longitudinal direction of the machine.

2. The machine according to claim 1, wherein said vibration generator comprises two imbalance masses to be set in rotation by said drive.

3. The machine according to claim 1, which comprises drives disposed to displace said flanged rollers relative to said assembly frame in a horizontal direction extending perpendicularly to the longitudinal direction of the machine.

4. The machine according to claim 1, which comprises a drive for displacing said lifting-lining unit relative to a machine frame in a longitudinal direction of the machine.

5. The machine according to claim 1, wherein said lifting-lining unit, equipped with a vibration generator, and said tamping unit are connected to a satellite frame that is displaceably mounted relative to a machine frame in a longitudinal direction of the machine.

6. A method of correcting a position of a track, the method comprising:

a) in a first working pass, gripping the track by a lifting-lining unit and lifting a section of the track into the target position prescribed by a track measuring system, and tamping the section by ballast compaction;

b) in a second working pass following the first working pass, loading the tamped section of the track, during continuous forward working travel, with a vertical load by way of drives connected to the lifting-lining unit and continuously vibrating the track by operation of a vibration generator.

7. The method according to claim 6, which comprises vibrating the track horizontally and transversely to the direction of the forward working travel.

* * * * *